US006232710B1

(12) United States Patent
Tanaka

(10) Patent No.: US 6,232,710 B1
(45) **Date of Patent: *May 15, 2001**

(54) COLOR CATHODE RAY TUBE WITH MASK SPRINGS

(75) Inventor: Toshihiko Tanaka, Mobara (JP)

(73) Assignee: Hitachi, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/444,992

(22) Filed: Nov. 23, 1999

Related U.S. Application Data

(63) Continuation of application No. 09/011,993, filed as application No. PCT/JP95/01847 on Sep. 18, 1995, now Pat. No. 6,020,680.

(51) Int. Cl.[7] ..... H01J 29/07
(52) U.S. Cl. ..... 313/404; 313/405; 313/407
(58) Field of Search ..... 313/404, 405, 313/407

(56) References Cited

U.S. PATENT DOCUMENTS

| | | | |
|---|---|---|---|
| 3,808,493 | 4/1974 | Kawamura et al. | 313/404 |
| 4,491,763 | 1/1985 | Fujinuma et al. | 313/405 |
| 4,652,792 | 3/1987 | Tokita et al. | 313/404 |
| 4,659,958 | 4/1987 | D'Amato | 313/405 |
| 4,827,180 | 5/1989 | Sone et al. | 313/404 |
| 5,680,004 | 10/1997 | Ragland, Jr. | 313/405 |

*Primary Examiner*—Michael H. Day
(74) *Attorney, Agent, or Firm*—Antonelli, Terry, Stout & Kraus, LLP

(57) ABSTRACT

A color cathode ray tube, having a panel portion including a shadow mask structure, a neck portion housing an electron gun and a funnel portion connecting the panel portion and neck portion. The shadow mask structure having a plurality of electron beam passing holes, a substantially rectangular support frame for holding the shadow mask, and at least three of mask springs which are fixed outside wall of side of the substantially rectangular support frame. The mask springs have holding hole to the panel pins, respectively, the portion of the holding hole of the mask spring shift from the fixed portion on outside wall of said rectangular support frame. The mask spring has a value of coefficient of thermal expansion which is from 1.2 to 2.0 times as great as the coefficient of thermal expansion of the support frame.

17 Claims, 4 Drawing Sheets

| | Embodiment | Prior Art |
|---|---|---|
| Coefficient of thermal expansion of shadow mask | invar, $6.9\times10^{-6}$/℃ | invar, $6.9\times10^{-6}$/℃ |
| Coefficient of thermal expansion of support frame | steel, $1.15\times10^{-5}$/℃ | steel, $1.15\times10^{-5}$/℃ |
| Coefficient of thermal expansion of mask springs | SUS304 $1.73\times10^{-5}$/℃ | SUS420 $1.04\times10^{-5}$/℃ |

| | Embodiment | Prior Art |
|---|---|---|
| Coefficient of thermal expansion of shadow mask | invar, $6.9\times10^{-6}$/℃ | invar, $6.9\times10^{-6}$/℃ |
| Coefficient of thermal expansion of support frame | steel, $1.15\times10^{-5}$/℃ | steel, $1.15\times10^{-5}$/℃ |
| Coefficient of thermal expansion of mask springs | SUS304 $1.73\times10^{-5}$/℃ | SUS420 $1.04\times10^{-5}$/℃ |

COLOR CATHODE RAY TUBE WITH MASK SPRINGS

CROSS REFERENCE TO RELATED APPLICATION

This is a continuation of U.S. application Ser. No. 09/011,993, filed Mar. 10, 1998, now U.S. Pat. No. 6,020,680, issued Feb. 1, 2000 which is a 371 of PCT/JP95/01847 filed Sep. 18, 1995, the subject matter of which is incorporated by reference herein.

BACKGROUND OF THE INVENTION

The present invention relates to a color cathode ray tube of the type which may be incorporated in a color monitor or in a color TV set; and, more particularly, the invention relates to a color cathode ray tube which decreases the occurrence of beam landing error caused by the movement of a shadow mask structure resulting from a rise in the temperature in the set or a rise in the temperature of the shadow mask, when the color monitor or the color TV set is operated.

A color cathode ray tube is generally constituted by a panel portion, which forms a picture screen, a neck portion for housing an electron gun, and a funnel portion for connecting the panel portion to the neck portion. On the funnel portion, there is provided a deflection device for scanning an electron beam, emitted from an electron gun, on a fluorescent screen formed on the inner surface of the panel.

FIG. 1 is a diagram schematically illustrating the basic structure of a cathode ray tube, which includes a panel 1, a funnel 2, a neck portion 3, a fluorescent screen (screen) 4, a shadow mask structure 5, panel pins 51 for supporting the shadow mask structure, a magnetic shield 6, deflection yokes 7, a magnet 8 for adjusting the purity, a magnet 9 for adjusting the center beam static convergence, a magnet 10 for adjusting the side beam static convergence, and an electron gun 11 which produces electron beams B.

The electron beams for R (red), G (green) and B (blue) colors are deflected in the horizontal direction and in the vertical direction by the deflection device (yokes), provided on the funnel portion, on the way from the electron gun to the fluorescent screen, are selected depending upon the colors by the shadow mask disposed in the panel portion, and impinge upon the fluorescent screen, whereby the fluorescent screen emits light in different colors so that an image is formed on the fluorescent screen.

FIG. 2 is a diagram schematically illustrating the shadow mask structure which comprises a shadow mask 12 having a plurality of electron beam passing openings for selecting colors, a support frame 13 for holding the shadow mask 12, and mask springs 14 for holding the support frame 13 in the panel. The shadow mask structure 5 is held by joining the mask spring-holding holes 141 to the panel pins 51 formed on the panel. Furthermore, the mask spring-holding holes 141 are positioned on a vertical axis or on a horizontal axis that passes nearly through the center of the shadow mask structure 5.

In general, the shadow mask 12 is made of invar (e.g., having a coefficient of thermal expansion of $6.9\times10^{-6}$/° C.), the support frame 13 is made of a steel (e.g., having a coefficient of thermal expansion of $1.15\times10^{-5}$/° C.), and the mask springs 14 are made of a stainless steel (e.g., having a coefficient of thermal expansion of $1.04\times10^{-5}$/° C.). Hereinafter, the term coefficient of thermal expansion refers to the coefficient of linear thermal expansion. In this case, the shadow mask 12 which is nearly flat, suppresses the doming of the shadow mask having low thermal expansion of the invar. In order to decrease the change with time of beam landing in the case of full-luster display, furthermore, the mask springs 14 are often made of a single material without a bimetal function.

When the cathode ray tube incorporated in a color monitor or in a color TV set (hereinafter referred to as the set) is operated, the temperature in the set containing the funnel portion and the neck portion gradually rise, due to heat energy generated by the circuit components in the set, and eventually reaches an equilibrium. Since the screen of the panel is exposed, it has a temperature lower than the temperature inside the set. The heat energy generated by the circuit components in the set raises the temperature in the set and, then, raises the temperature of the funnel. Moreover, the temperature of the inner shield is raised due to radiant heat, causing the temperatures of the support frame and the mask springs to be raised, too.

The temperature surrounding the cathode ray tube is lower at the panel portion than the funnel portion. Thus, the temperature of the panel portion is lower than the temperature of the funnel portion. Therefore, the mask springs joined to the panel pins buried in the panel are heated to a lesser degree than the support frame and are not thermally expanded by the same amount when the mask springs and the support frame have the same coefficient of thermal expansion.

For example, a mask spring support point 141 on the short side or on the long side of the shadow mask structure and a point 131 on the support frame in the vicinity thereof are on the same straight line as a mask spring support point 141 on the opposite side of the mask with respect to the above-mentioned mask spring support point 141 and a point 131 on the support frame in the vicinity thereof. When their positional relationship is maintained, the shadow mask is not distorted. Actually, however, the mask springs and the support frame are not thermally expanded by the same amount, causing the shadow mask structure to be distorted. Distortion in the shadow mask structure causes beam landing shift, deteriorating the color purity.

FIG. 3 illustrates by arrows the motion of points 131 on the support frame near the mask spring support points 141 in the four-pin type shadow mask structure in which the mask springs have a coefficient of thermal expansion nearly equal to that of the support frame, i.e., in which the amount of thermal expansion of the mask springs is smaller than the amount of thermal expansion of the support frame. As described above, the motion of points 131 on the support frame near the mask spring support points 141 is caused by the difference in the thermal expansion between the mask springs 14 and the support frame 13 as a result of an increase in the temperature in the set. In the four-pin type shadow mask structure, the points 131 move in the directions of the arrows; i.e., the shadow mask as a whole is subjected to a rotational force.

FIG. 4 is a diagram illustrating the motion of points 131 on the support frame near the mask spring support points 141 of a three-pin type shadow mask structure, which occurs when the thermal expansion of the mask springs is smaller than the thermal expansion of the support frame, and in which the points 131 move in the directions of the arrows. In the three-pin type shadow mask structure, therefore, the points 131 move in the directions of the arrows, and the force is concentrated on the right upper corner portion of the shadow mask. FIG. 5 shows the directions of shift of the electron beam landing that occurs when a cathode ray tube using the three-pin type shadow mask structure shown in FIG. 4 is mounted on a color TV set.

In general, the mask springs and the support frame are designed by taking into consideration the heat energy that is generated at the support points when the electron beams impinge upon the shadow mask, but without taking into consideration the additional heat energy generated by the circuit components in the set. In a color display tube of the type used for a color monitor, in particular, the structure of the fluorescent screen is of the dot type and involves a stricter problem in regard to color purity than that of the fluorescent screen structure of the stripe type.

In a high definition color display tube in which the shadow mask for determining the dot pitch of the fluorescent screen has a hole pitch of smaller than 0.31 mm, furthermore, this becomes a more serious problem. Besides, in the color display tube, the number of the horizontal scanning lines must be increased. Therefore, the horizontal deflection frequency increases due to the deflection yokes, and an increased amount of heat is generated by the circuit components in the deflection yokes and in the set. The problem of heat generation becomes conspicuous, particularly in a high definition display in which the number of the horizontal scanning lines substantially exceeds 1000. The above-mentioned problem becomes serious, particularly in a high definition color display tube.

SUMMARY OF THE INVENTION

By using a shadow mask structure in which the mask springs have a coefficient of thermal expansion which is from 1.2 to 2.0 times as great as the coefficient of thermal expansion of the support frame, it is possible to suppress the difference between the thermal expansion of the mask spring and the thermal expansion of the support frame, preventing deterioration in the color purity caused by a beam landing shift that stems from the difference between the thermal expansion of the mask springs and the thermal expansion of the support frame, and, hence, providing a color cathode ray tube which stably maintains the color purity without being affected by a change in the temperature in the set.

DESCRIPTION OF THE EMBODIMENTS

Figure 1:
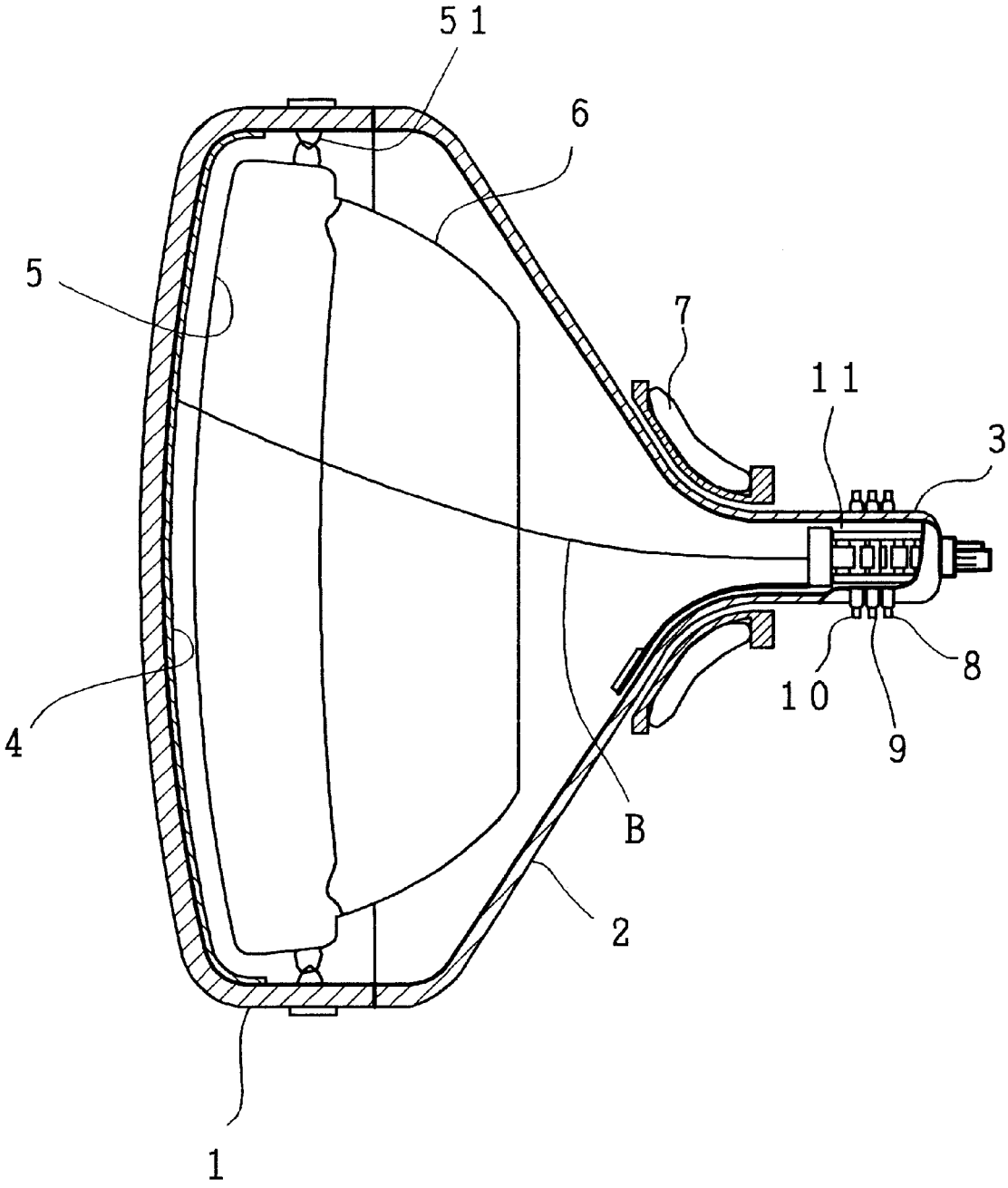
FIG. 1 (PRIOR ART)
FIG. 1 is a sectional view of a cathode ray tube.
Figure 2:
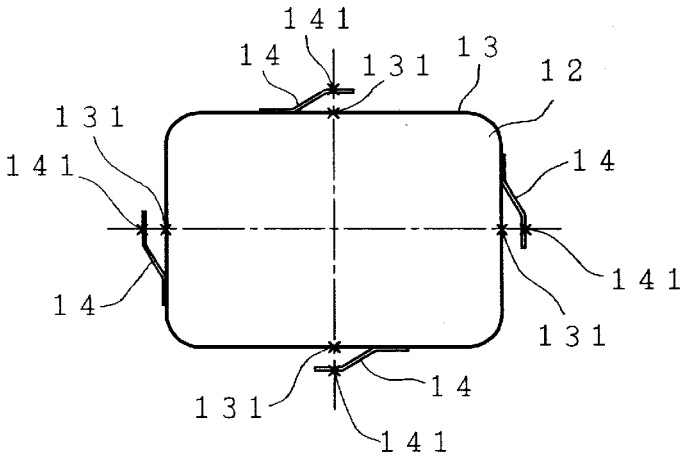
FIG. 2 (PRIOR ART)
FIG. 2 is a diagram schematically illustrating a shadow mask structure.
Figure 3:
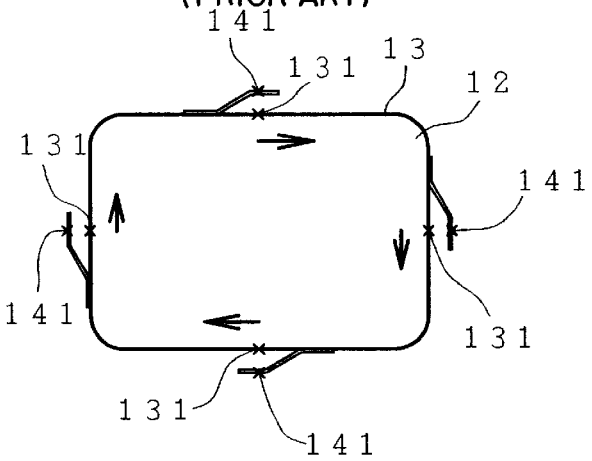
FIG. 3 (PRIOR ART)
FIG. 3 is a diagram illustrating the motion of points on the support frame near the mask spring in a conventional four-pin type shadow mask structure in which the coefficient of thermal expansion of the mask springs is nearly the same as the coefficient of thermal expansion of the support frame.
Figure 4:
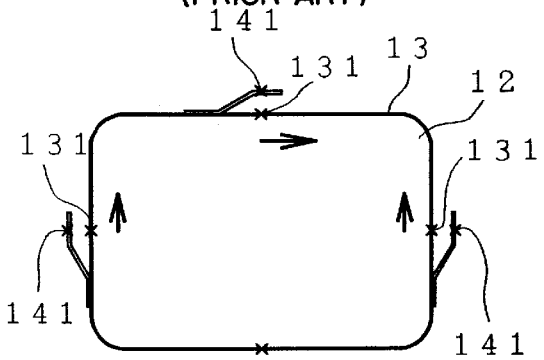
FIG. 4 (PRIOR ART)
FIG. 4 is a diagram illustrating the motion of points on the support frame near the mask spring support points in a conventional three-pin type shadow mask in which the coefficient of thermal expansion of the mask springs is nearly the same as the coefficient of thermal expansion of the support frame.
Figure 5:
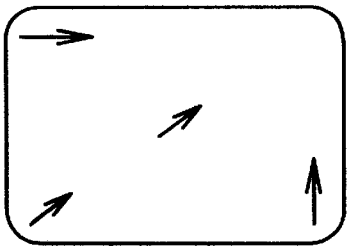
FIG. 5 (PRIOR ART)
FIG. 5 is a diagram showing the directions of beam landing shift in a cathode ray tube using a conventional three-pin type shadow mask structure, in which the coefficient of thermal expansion of the mask springs is nearly the same as the coefficient of thermal expansion of the support frame.
Figures 6, 7:
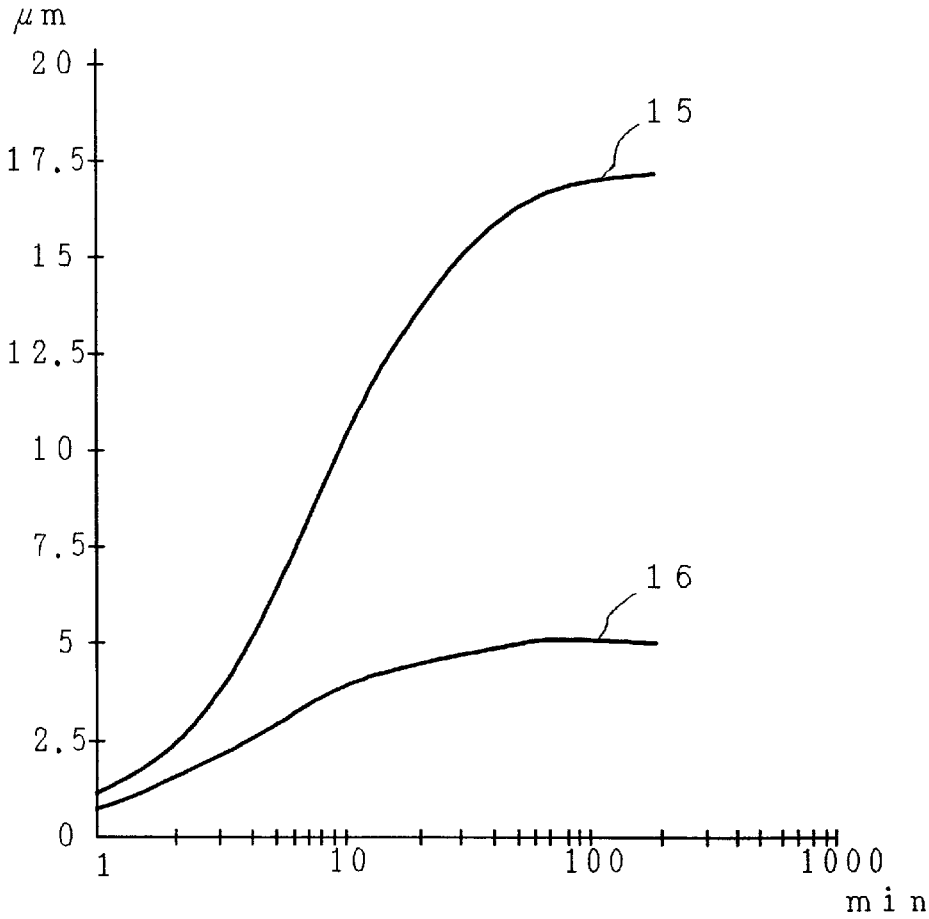
FIG. 6 is a table of values for comparison of an embodiment of the present invention with a conventional example wherein stainless steel of the Japanese Industrial Standard SUS304 and SUS420 are indicated.
FIG. 7 is a graph for comparison of the amount of shift of the beam of the three-pin type shadow mask structure of the embodiment of the invention with that of the conventional example, with the lapse of time.

FIG. 6 is a table of values showing a comparison of an embodiment of the present invention with a conventional example. In accordance with the present invention, a shadow mask 12 is made of invar (coefficient of thermal expansion of $6.9\times10^{-6}$/° C.), a support frame 13 is made of a steel (coefficient of thermal expansion of $1.15\times10^{-5}$/° C.) and mask springs 14 are made of a stainless steel (coefficient of thermal expansion of $1.73\times10^{-5}$/° C.).

Owing to the use of the shadow mask 12 of this embodiment constituted by using the above-mentioned materials, the coefficient of thermal expansion ($1.73\times10^{-5}$/° C.) of the mask springs 14 is 1.5 times as great as the coefficient of thermal expansion ($1.15\times10^{-5}$/° C.) of the support frame 13, when the temperature of the support frame is greatly raised because of a rise in the temperature in the set, and when the temperature of the mask springs is little raised. Therefore, the difference in the amount of thermal expansion is small between the mask springs 14 and the support frame 13. The motion of the points 131 on the support frame 13 near the support points 141 of the mask springs 14 that hold the color cathode ray tube in the panel, and caused by a rise in the temperature in the set, is canceled by the thermal expansion of the mask springs.

The amount of movement of the shadow mask welded to the support frame decreases with a decrease in the amount of movement of the support frame, and the beam landing shift decreases, too.

FIG. 7 shows the beam landing characteristics when the present invention is applied to a shadow mask structure having three-pin type springs, being used in a 36-cm color display tube operated in a monitor or TV set. The graph in FIG. 7 shows the conventional beam landing characteristics in comparison with the beam landing characteristics of the present invention.

In FIG. 7, the ordinate represents the shift of the electron beam in $\mu$m and the abscissa represents the passage of time in minutes. Line 15 represents the amount of movement of a beam at the left lower corner of the panel using the conventional color display tube, and line 16 represents the amount of movement of a beam at the left lower corner of the panel using the color display tube of the present invention. When the display tube is operated which mounted in the set, the temperature in the set reaches an equilibrium at 50° C. The temperature in the set is measured at an upper part of the funnel. By embodying the present invention, the amount of change in the beam landing can be greatly decreased to 5 $\mu$m from 17 $\mu$m after operation for 100 minutes. That is, the amount of change in the beam landing can be decreased at the peripheries of the panel screen.

In the above-mentioned embodiment, the mask springs 14 were made of a stainless steel. In general color cathode ray tubes, however, the mask springs 14 are often constituted by a bimetal to cope with the so-called doming problem. In the case of using bimetal springs, the coefficient of equivalent thermal expansion of the springs is an average value of the coefficients of thermal expansion of the two metals.

Figure 8:
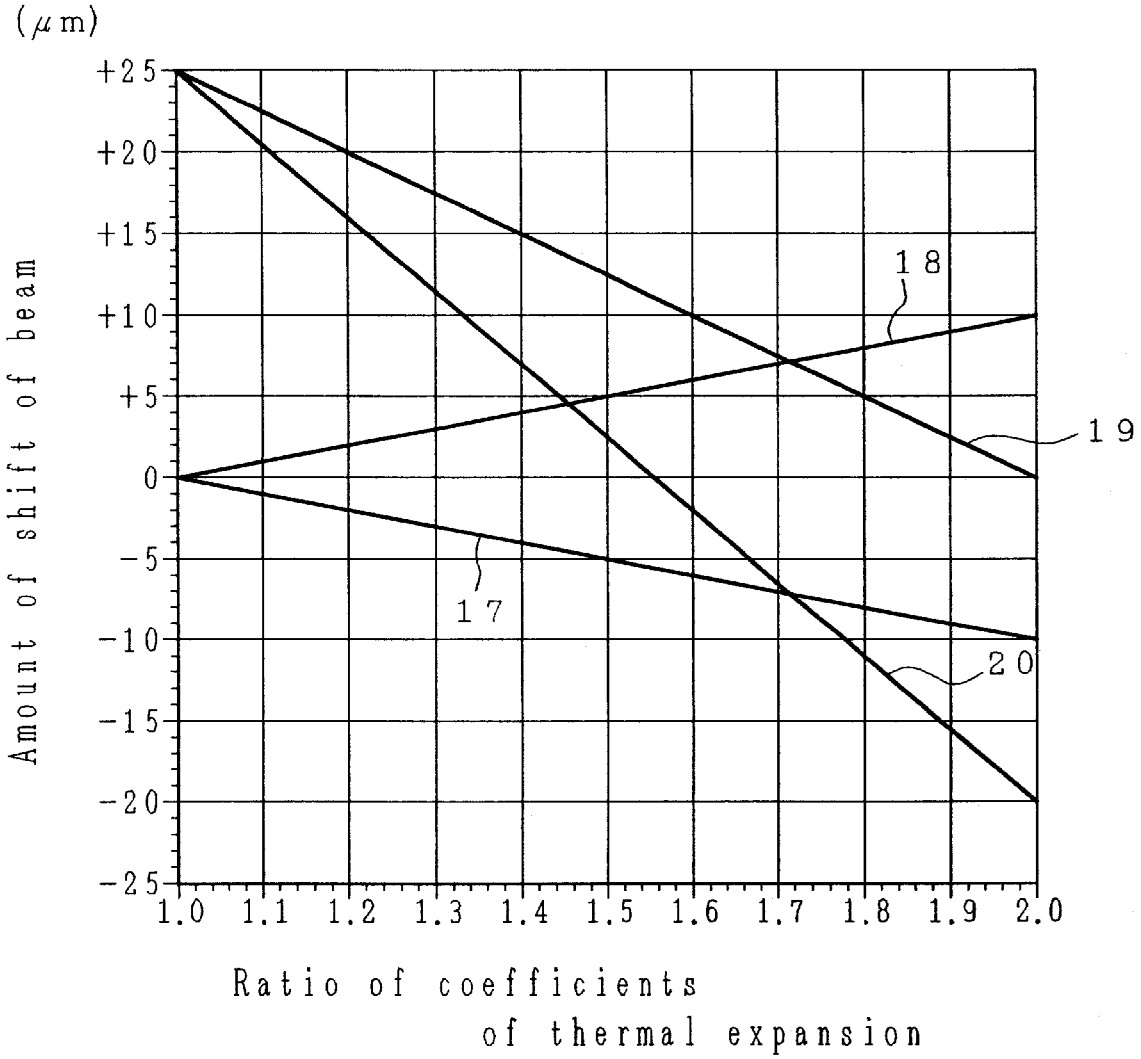
FIG. 8 is a diagram illustrating the relationship between the amount of shift of the beam and the ratio of the coefficient of thermal expansion of the mask springs to the coefficient of thermal expansion of the support frame.

FIG. 8 is a diagram illustrating the relationship among the amount of movement of the beam, the temperature and the ratio of the coefficient of thermal expansion of the mask springs to the coefficient of thermal expansion of the support frame. The environmental temperature was assumed to be 40° C., which is a high temperature, and 0° C., which is a low temperature, and the temperature difference between the inside and the outside of the set was 25° C., i.e., the temperature difference between the periphery of the panel and the periphery of the funnel was 25° C.

In FIG. 8, line 17 represents the relationship between the ratio of coefficients of thermal expansion and the amount of shift of the beam in a case where the environmental temperature is high and there is no temperature difference between the inside of the set and the outside of the set; line 18 represents the relationship in na case where the environmental temperature is low and there is no temperature difference between the inside of the set and the outside of the set; line 19 represents the relationship in a case where the environmental temperature is low and the temperature difference is 25° C. between the inside of the set and the outside of the set; and line 20 represents the relationship in a case where the environmental temperature is high and the temperature difference is 25° C. between the inside of the set and the outside of the set. The measurement point is in an upper part at the center of the panel, and a rightward shift beyond the measurement point is regarded to be a positive (+) movement and a leftward shift is regarded to be a negative (−) movement.

When the ratio of the coefficients of thermal expansion is 1.0, the environmental temperature of the whole cathode ray tube is uniform, when there is no temperature difference between the outside of the set and the inside of the set, irrespective of whether the environmental temperature is high or low, and the amount of shift of the beam is 0 μm. When the environmental temperature is low and there is a temperature difference between the periphery of the panel and the periphery of the funnel, or when the environmental temperature is high and there is a temperature difference between the periphery of the panel and the periphery of the funnel, the amount of shift of the beam is 25 μm.

When the ratio of the coefficients of thermal expansion is 2.0 and when there is no temperature difference between the outside of the set and the inside of the set, the amount of shift of the beam is 10 μm, when the environmental temperature is high, and 10 μm, when the environmental temperature is low. When the environmental temperature is low and there is a temperature difference between the periphery of the panel and the periphery of the funnel, the amount of shift of the beam is 0 μm. When the environmental temperature is high and there is a temperature difference between the periphery of the panel and the periphery of the funnel, the amount of shift of the beam is −20 μm.

When the allowable range of the amount of shift of the beam landing is determined to be ±20 μm from the visual point of view, then, the ratio of coefficients of thermal expansion is from 1.2 to 2.0. When the ratio of coefficients of thermal expansion is 1.71, furthermore, the amount of shift of the beam landing is ±7 μm which is a minimum amount.

As described above, the color cathode ray tube of the present invention is incorporated in a color monitor set or a color TV set, and is adapted to be used under conditions where the temperature rises in the color monitor or in the color TV set or where a temperature difference occurs between the mask frame and the mask springs.

What is claimed is:

1. A color cathode ray tube, comprising a panel portion including a shadow mask structure, a neck portion housing an electron gun and a funnel portion connecting said panel portion and neck portion, said shadow mask structure including a shadow mask having a plurality of electron beam passing holes, a substantially rectangular support frame for holding said shadow mask, and at least three mask springs which are fixed to an outside wall side of said substantially rectangular support frame, said mask springs having a holding hole for a respective panel pin, a portion of said holding hole of said mask spring being shifted in a lateral direction from a portion wherein said mask spring is fixed to the outside wall of said rectangular support frame, and said mask springs in an entirety thereof have a value of coefficient of thermal expansion which is from 1.2 to 2.0 times as great as the coefficient of thermal expansion of said support frame.

2. A color cathode ray tube according to claim 1, wherein said support frame is made of steel, and said mask springs are made of a stainless steel.

3. A color cathode ray tube according to claim 2, wherein the stainless steel is stainless steel of SUS304 in accordance with the Japanese Industrial Standard.

4. A color cathode ray tube according to claim 1, wherein said mask springs are made of a bimetal and said coefficient of thermal expansion of said mask springs is an average value of the coefficient of thermal expansion of the two metals.

5. A color cathode ray tube according to claim 1, wherein said mask springs are made of a monometal.

6. A color cathode ray tube, comprising a panel portion including a shadow mask structure, a neck portion housing an electron gun and a funnel portion connecting said panel portion and neck portion, said shadow mask structure including a shadow mask having a plurality of electron beam passing holes, a substantially rectangular support frame for holding said shadow mask, and a mask spring which is fixed on a side of said support frame and having a holding hole, said holding hole of said mask spring being positioned substantially at a center of a side of said support where said mask spring is arranged, and a portion of said mask spring where said mask spring is fixed to said support frame being shifted in a lateral direction from the portion of said holding hole of said mask spring in a direction toward a corner of said rectangular support frame, and said mask springs in an entirety thereof have a value of coefficient of thermal expansion which is from 1.2 to 2.0 times as great as the coefficient of thermal expansion of said support frame.

7. A color cathode ray tube according to claim 6, wherein said support frame is made of steel, and said mask springs are made of a stainless steel.

8. A color cathode ray tube according to claim 7, wherein the stainless steel is stainless steel of SUS304 in accordance with the Japanese Industrial Standard.

9. A color cathode ray tube according to claim 6, wherein said mask springs are made of a bimetal and said coefficient of thermal expansion of said mask spring is an average value of the coefficient of thermal expansion of the two metals.

10. A color cathode ray tube according to claim 6, wherein said mask springs are made of a monometal.

11. A color cathode ray tube, comprising a panel portion including a shadow mask structure, a neck portion housing an electron gun and a funnel portion connecting said panel portion and neck portion, said shadow mask structure including a shadow mask having a plurality of electron beam passing holes, a substantially rectangular support frame for holding said shadow mask, and a mask spring which is fixed on a side of said support frame and having a holding hole, a portion of said holding hole of said mask spring being shifted in a lateral direction from a portion where said mask spring is fixed on an outside wall of said rectangular support frame to a side direction of said rectangular support frame, and said shadow mask is made of invar, said support frame is made of steel, and said mask spring in an entirety thereof has a value of coefficient of thermal expansion which is from 1.2 to 2.0 times as great as a coefficient of thermal expansion of said support frame.

12. A color cathode ray tube according to claim 11, wherein said support frame is made of steel, and said mask spring is made of a stainless steel.

13. A color cathode ray tube according to claim 12, wherein the stainless steel is stainless steel of SUS304 in accordance with the Japanese Industrial Standard.

14. A color cathode ray tube according to claim 11, wherein said mask spring is made of a bimetal and said coefficient of thermal expansion of said mask spring is an average value of the coefficient of thermal expansion of the two metals.

15. A color cathode ray tube according to claim 11, wherein said mask spring is made of a monometal.

16. A color cathode ray tube according to claim 11, wherein said portion of said holding hole of said mask spring is positioned substantially at a center of a side of said rectangular support frame and said portion where said mask spring is fixed is shifted in a direction of a corner of said rectangular support frame.

17. A color cathode ray tube according to claim 11, wherein a plurality of said mask spring are provided.

* * * * *